United States Patent [19]

Bianchetta

[11] 3,982,469

[45] Sept. 28, 1976

[54] APPARATUS FOR CONTROLLING WORK ELEMENT OPERATING PRESSURES IN A FLUID SYSTEM

[75] Inventor: Donald L. Bianchetta, Coal City, Ill.

[73] Assignee: Caterpillar Tractor Co., Peoria, Ill.

[22] Filed: Jan. 23, 1976

[21] Appl. No.: 651,890

[52] U.S. Cl. ..... 91/412; 60/484

[51] Int. Cl.[2] ..... F15B 11/16

[58] Field of Search ..... 91/170, 171, 189, 418, 91/444, 412; 60/484

[56] References Cited

UNITED STATES PATENTS

| | | | |
|---|---|---|---|
| 2,301,028 | 11/1942 | Esch | 91/412 X |
| 3,868,821 | 3/1975 | Ratliff et al. | 91/412 X |
| 3,895,564 | 7/1975 | Pinson | 91/444 X |

*Primary Examiner*—Edgar W. Geoghegan

*Attorney, Agent, or Firm*—Frank L. Hart

[57] ABSTRACT

A fluid system of a vehicle has means for reducing waste by separately controlling the maximum operating pressure of separate portions of the fluid system serving work elements of the vehicle.

5 Claims, 1 Drawing Figure

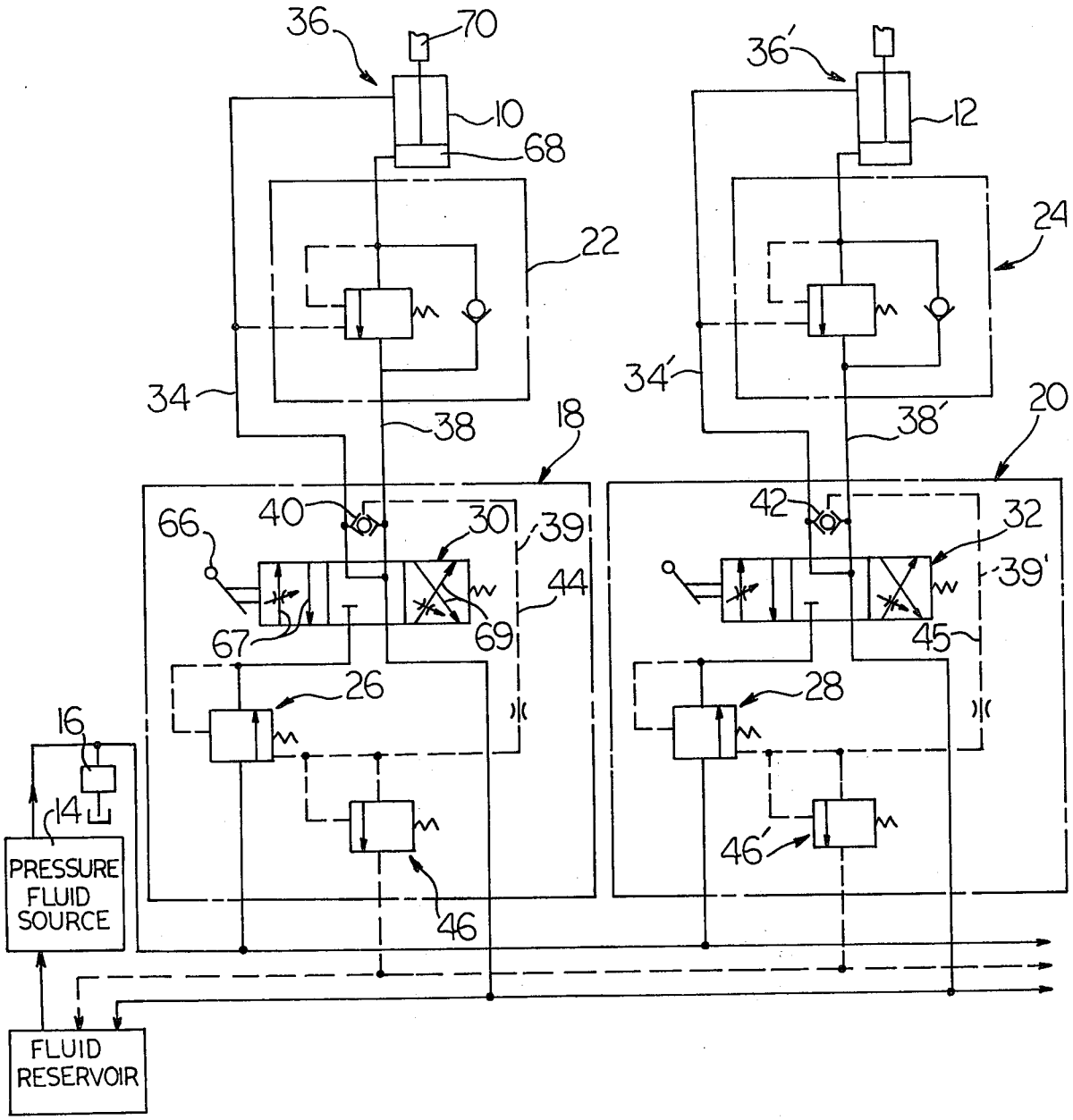
36
70
10
68
22
34
38
18
66
40
30
39
44
67
69
26
16
14
PRESSURE FLUID SOURCE
46
FLUID RESERVOIR
36'
12
24
34'
38'
20
42
32
39'
45
28
46'

APPARATUS FOR CONTROLLING WORK ELEMENT OPERATING PRESSURES IN A FLUID SYSTEM

BACKGROUND OF THE INVENTION

In the operation of a vehicle having a plurality of hydraulically operated work elements, as for example an excavator, when the piston of one of the work elements bottoms out, the hydraulic system pressure increases to the setting of the main pressure relief valve of the hydraulic system. It is therefore desirable to provide means associated with each working element to separately control the maximum pressure buildup of each working element and its hydraulic system. By constructing apparatus of this invention to maintain a pressure not greater than a preselected operating pressure for each working element, waste of energy and materials is reduced. Each working element can be constructed to withstand and operate at only the maximum operating pressure that will be subjected onto that particular working element.

This invention therefore resides in apparatus for reducing waste by separately controlling the maximum operating pressure of separate portions of the fluid system serving separate work elements of the vehicle.

BRIEF DESCRIPTION OF THE DRAWING

The drawing is a diagrammatic view of a portion of a hydraulic system of a vehicle having a plurality of separate work elements.

DETAILED DESCRIPTION OF THE INVENTION

Referring to the drawing, a vehicle (not shown), for example an excavator, has a plurality of working elements 10, 12 that are operated by a fluid system, preferably a hydraulic system of the vehicle. The working elements 10, 12 can be of various types such as hydraulic cylinders of the bucket and the boom of the excavator, for example. The working elements 10, 12 are each connected to a pressurized hydraulic fluid source 14, a safety pressure relief valve 16, and separate, respective first and second control valve assemblies 18, 20, and first and second counterbalance valves 22, 24. The pressurized hydraulic fluid source 14 preferably provides fluid at a substantially constant pressure.

The first and second control valve assemblies 18, 20 have separate, respective first and second two-way pressure compensated flow control valves 26, 28 positioned between separate, respective first and second directional control valves 30, 32 and the pressurized fluid source 14. The directional control valves 30, 32 are each connected to a respective counterbalance valve 22, 24 which in turn is connected to a respective working element 10, 12.

Each of the directional control valves 30, 32 has a first conduit 34, 34' connected to the rod end 36, 36' of the respective work element 10, 12 and a second conduit 38, 38' connected to the respective counterbalance valve 22, 24 for controlled passage of hydraulic fluid from their respective working elements 10, 12.

Signal means 39, 39' each have a resolver valve 40, 42 in fluid communication with the respective first and second conduits 34, 38 and 34', 38' for sensing the fluid pressures in said conduits and delivering a respective pressure signal that is the larger of said sensed pressures to the respective two-way pressure compensated flow control valve 26, 28 for controllably biasing said flow control valves 26, 28 toward an open position in response to said respective delivered pressure signals. First and second conduit means 44, 45 are provided for passing the pressure signal from respective resolver valves 40, 42 to respective two-way flow control valves 26, 28. Where the work elements 10, 12 are single acting elements, the signal means 39, 39' do not need the resolver valve 40, 42.

Signal pressure relief valves 46, 46' are each connected in fluid communication with respective first and second conduit means 44, 45 for selectively, controllably passing hydraulic fluid from the first and second conduit means 44, 45 for maintaining each respective pressure less than a respective preselected value.

Although the hydraulic system has been described with reference to two different working elements and their hydraulic components, it should be understood that this invention is not limited thereto and can be used with a single working element or with a multiplicity of such elements.

In describing the operation of the hydraulic system, reference will generally be made to only the hydraulic portion serving the first working element 10 since the associated elements of the second working element are common with those of the first except for the operating pressure of relief valves 46, 46'.

Lever 66 is moved toward or from the directional control valve 30 for shifting said valve 30 to the right or left. At the right shifted position, passageways 67 communicate with conduits 34, 38 for passing hydraulic fluid to the rod end 36 of work element 10 via conduit 34 and from the head end 68 of work element 10 via conduit 38. At the left shifted position, passageways 69 communicate with conduits 34, 38 for passing hydraulic fluid from the rod end 36 of work element 10 via conduit 34 and to the head end 68 of work element 10 via conduit 38. Therefore, at the right shifted position of valve 30, the actuating element 70 associated with the work element 10 is caused to retract and at the left shifted position, said actuating element 70 is caused to extend.

When the working element 10 bottoms out at either the fully extended or fully retracted positions of the actuating element 70, the hydraulic pressure in respective conduits 34 or 38 will increase to the magnitude of the fluid from the pressure source 14.

By utilizing the apparatus of this invention, the largest pressure of conduits 34, 38 passes to flow control valve 26 through conduit means 44. Since pressure signal relief valve 46 is in communication with conduit 44 and is constructed to open at a preselected pressure based on the desired operating pressure of work element 10, said signal pressure relief valve 46 will open, reduce the pressure of conduit 44, cause flow control valve 26 to close, and prevent the pressure subjected on work element 10 from increasing above said preselected value while the pressure subjected on work element 12 is free to increase.

By this construction, for example, a first relief valve can have an opening pressure of 1000 psi, a second relief valve can have an opening pressure of 2000 psi, a third relief valve can have an opening pressure of 4000 psi, and the pressure source 14 can have a maximum pressure of 4100 psi. The first working element can be designed for maximum pressure of 1500 psi, the second for 2500 psi, etc. The system can then be operated through various pressures to 4100 psi without subjecting the working elements and their associated hydraulic system upstream of their flow control valve 26 to their individual distinctive pressures and waste is reduced by constructing each working element and its associated equipment to withstand a pressure only as high as is necessary to operate the particular apparatus with which they are associated.

Without the apparatus of this invention, each working element must be constructed to withstand the maximum pressure determined by the main pressure relief valve. Thus, the apparatus of this invention also offers the designer greater control flexibility.

Other aspects, objects, and advantages of this invention can be obtained from a study of the drawing, the disclosure, and the appended claims.

What is claimed is:

1. In a fluid system having a pressurized fluid source connected to at least one working element through a safety pressure relief valve constructed to open in response to a first preselected pressure, and a control valve assembly having a flow control valve positioned between a directional control valve and the pressurized fluid source, said directional control valve having a first conduit connected to one end of the work element for controllably passing fluid therebetween, the improvement comprising:

signal means in fluid communication with the first conduit for sensing the fluid pressure in said conduit and delivering said sensed pressure as a pressure signal to the flow control valve for controllably biasing said flow control valve toward an open position in response to said delivered pressure signal; and a signal pressure relief valve connected in fluid communication with the signal means for controllably passing fluid from the signal means for limiting the pressure on the working element to a second preselected value, said second preselected value being less than said first preselected value of said safety pressure relief valve.

2. Apparatus, as set forth in claim 1, wherein the pressurized fluid source is connected to a plurality of working elements through the safety pressure relief valve, each working element being connected to a separate control valve assembly having a respective flow control positioned between a respective directional control valve and the pressurized fluid source, each directional control valve having a first conduit connected to a respective work element for controllably passing fluid therebetween, and including:

separate signal means each being in fluid communication with a respective first conduit for sensing the fluid pressure in said conduit and delivering said sensed pressure as a separate pressure signal to a respective flow control valve for controllably biasing said flow control valves toward open positions in response to said delivered pressure signals; and separate signal pressure relief valve each being connected in fluid communication with a respective signal means for controllably, separately passing fluid from the signal pressure relief valve for maintaining the pressures on said respective working elements at preselected values.

3. Apparatus, as set forth in claim 2, wherein the plurality of signal pressure relief valves each have a preselected pressure, said preselected pressures of the plurality of signal pressure relief valves are each of a lower magnitude then the first preselected pressure of the safety pressure relief valve, and at least one of the signal pressure relief valves has a preselected pressure of a different magnitude than other relief valve preselected pressures.

4. Apparatus, as set forth in claim 1, including:

a second conduit connected to another end of the work element and to the directional control valve for controllably passing fluid therebetween; and wherein the signal means is in fluid communication with the second conduit and is of a construction for delivering the larger of the sensed pressures of the first and second conduits as said pressure signal.

5. Apparatus, as set forth in claim 1, wherein said flow control valve is a two-way valve movable between a first position at which flow is blocked between the pressurized fluid source and the directional control valve and a second position at which the pressurized fluid source and the directional control valve are in fluid communication.

* * * * *

Disclaimer 3,982,469.—*Donald L. Bianchetta*, Coal City, Ill. APPARATUS FOR CONTROLLING WORK ELEMENT OPERATING PRESSURES IN A FLUID SYSTEM. Patent dated Sept. 28, 1976. Disclaimer filed Aug. 8, 1980, by the assignee, *Caterpillar Tractor Co.*

Hereby enters this disclaimer to all claims of said patent.

[*Official Gazette September 30, 1980.*]